US008950295B2

(12) United States Patent
Chiang

(10) Patent No.: US 8,950,295 B2
(45) Date of Patent: Feb. 10, 2015

(54) ADJUSTABLE WRENCH DEVICE

(71) Applicant: Wen Hung Chiang, Taichung (TW)

(72) Inventor: Wen Hung Chiang, Taichung (TW)

( * ) Notice: Subject to any disclaimer, the term of this patent is extended or adjusted under 35 U.S.C. 154(b) by 145 days.

(21) Appl. No.: 13/802,936

(22) Filed: Mar. 14, 2013

(65) Prior Publication Data

US 2014/0260818 A1 Sep. 18, 2014

(51) Int. Cl.
*B25B 13/46* (2006.01)
*B25B 13/12* (2006.01)
*B25B 13/44* (2006.01)

(52) U.S. Cl.
CPC ..... *B25B 13/463* (2013.01); *B25B 13/12* (2013.01)
USPC ..... 81/63; 81/128

(58) Field of Classification Search
USPC ..... 81/63, 63.2, 128; 279/114
See application file for complete search history.

(56) References Cited

U.S. PATENT DOCUMENTS

| | | | | |
|---|---|---|---|---|
| 5,305,670 | A | 4/1994 | Fossella et al. | |
| 5,448,931 | A | 9/1995 | Fossella et al. | |
| 5,819,607 | A | 10/1998 | Carnesi | |
| 5,996,446 | A | 12/1999 | Lee | |
| 6,073,522 | A | 6/2000 | Carnesi | |
| 7,062,996 | B2 | 6/2006 | Johnson | |
| 7,261,021 | B1 | 8/2007 | Carnesi et al. | |
| 7,707,916 | B2 * | 5/2010 | Pirseyedi | 81/128 |
| 7,946,200 | B2 * | 5/2011 | Chang | 81/128 |
| 8,677,864 | B1 * | 3/2014 | Wheeler | 81/128 |
| 2010/0000379 | A1 * | 1/2010 | Hsu Chang | 81/129 |

* cited by examiner

*Primary Examiner* — David B Thomas
(74) *Attorney, Agent, or Firm* — Charles E. Baxley

(57) ABSTRACT

An adjustable wrench device includes a housing engaged in a head and having an internal gear, a rotary member engaged in the housing, a sleeve attached to the housing and engaged with the rotary member for confining the rotary member in the housing, the sleeve includes an opening having two spirally arranged cam surfaces and having two or more pairs of depressions, two jaw members are engaged with the rotary member and moveable toward and away from each other to engage with either pair of depressions for adjusting the spacing distance between the jaw members and for adjustably gripping bolt heads or nuts or fittings of different sizes or dimensions or diameters.

7 Claims, 4 Drawing Sheets

ADJUSTABLE WRENCH DEVICE

BACKGROUND OF THE INVENTION

1. Field of the Invention

The present invention relates generally to wrenches and similar mechanical devices having adjustable jaws, or relates to an adjustable wrench device, and more particularly to an adjustable wrench device including two opposed slidable jaw members that enables a user to quickly adjust to various sizes or dimensions by rotating a portion of the wrench device.

2. Description of the Prior Art

A single wrench or gripping tool having adjustably positionable jaws to grip various sizes or dimensions or diameters of bolt heads, nuts, and other fittings has been a goal of the tool making industry for decades. Various devices have been developed in the past, with these devices having various degrees of success in industry and the marketplace.

For example, U.S. Pat. No. 5,305,670 to Fossella et al., U.S. Pat. No. 5,448,931 to Fossella et al., U.S. Pat. No. 5,819,607 to Carnesi, U.S. Pat. No. 5,996,446 to Lee, U.S. Pat. No. 6,073,522 to Carnesi, U.S. Pat. No. 7,062,996 to Johnson, and U.S. Pat. No. 7,261,021 to Carnesi disclose several of the typical adjustable wrench devices each comprising two movable or adjustable jaws that are movable or adjustable relative to each other in order to grasp or grip fastener heads or fixtures or nuts or bolts with hexagonal heads of different sizes more tightly therebetween when torque is applied toward the jaws.

Although the adjustable wrench device allows the user to make the necessary adjustments, it includes numerous parts or components that may not be easily and quickly made or manufactured by the workers and that add to the cost of manufacturing the wrench device.

The present invention has arisen to mitigate and/or obviate the afore-described disadvantages of the conventional adjustable wrench devices.

SUMMARY OF THE INVENTION

The primary objective of the present invention is to provide an adjustable wrench device including two opposed slidable jaw members that enables a user to quickly adjust to various sizes or dimensions by rotating a portion of the wrench device.

The other objective of the present invention is to provide an adjustable wrench device including fewer parts or components that may be easily and quickly made or manufactured by the workers and that may be made or manufactured with a reduced manufacturing cost for the wrench device.

In accordance with one aspect of the invention, there is provided an adjustable wrench device comprising a driving handle including a head provided on one end portion of the handle, and including a chamber formed in the head and defined by an upper wall, and including an orifice formed in the upper wall of the head and communicating with the chamber of the head, and including a space formed in the handle and communicating with the chamber of the head, a driving cartridge including a housing rotatably received and engaged in the chamber of the head, and including a gear wheel formed on the housing and engaged in the chamber of the head, the housing including a stud extended upwardly therefrom and engaged through the orifice of the head for rotatably mounting the housing to the head, a detent pivotally received and engaged in the space of the handle and engaged with the gear wheel for determining a driving direction of the housing by the head and the handle, a control knob attached to the detent for rotating the detent relative to the head and the handle and the housing, the housing including a bore formed therein, and including an internal gear provided in the bore of the housing, and including a compartment formed in the housing and communicating with the bore of the housing, the driving cartridge including a rotary member rotatably received and engaged in the compartment of the housing, and including a sleeve attached to the housing and having a bottom panel engaged with the rotary member for confining the rotary member in the compartment of the housing, the sleeve including an opening formed in the bottom panel and including two spirally arranged cam surfaces for forming and defining the opening of the bottom panel, and including a first pair of depressions and at least one second pair of depressions formed in the spirally arranged cam surfaces and positioned and arranged anti-symmetric to each other, the rotary member including a guide channel formed therein, and two jaw members slidably received and engaged with the guide channel of the rotary member and guided to move toward and away from each other, in order to selectively engage with either the first pair or the second pair of depressions of the spirally arranged cam surfaces and in order to adjust a spacing distance between the jaw members and for adjusting the spacing distance between the jaw members and for adjustably gripping bolt heads or nuts or fittings of different sizes or dimensions or diameters, and the rotary member including a non-circular stem extended upwardly therefrom and received in the bore of the housing, and the driving cartridge including an actuating member slidably engaged into the bore of the housing, and the actuating member including a non-circular cavity formed therein for slidably receiving and engaging with the stem and for guiding the actuating member to be moved up and down relative to the head and the rotary member, and for allowing the actuating member to be rotated in concert with the rotary member relative to the housing, the actuating member including a gear for selectively engaging with the internal gear of the housing and for anchoring and retaining an engagement of the jaw members with either the first pair or the second pair of depressions of the spirally arranged cam surfaces, and the gear of the actuating member being disengaged from the internal gear of the housing when the actuating member is moved up relative to the head and the rotary member, for allowing the actuating member and the rotary member and the jaw members to be rotated and adjusted relative to the housing and the sleeve.

The rotary member includes a spring biasing member disposed and engaged between the jaw members for biasing and forcing and moving the jaw members to selectively engage with either the first pair or the second pair of depressions of the spirally arranged cam surfaces.

The housing includes an outer thread formed thereon, and the sleeve includes an inner thread for threading and engaging with the outer thread of the housing and for mounting and securing the sleeve to the housing. The head includes a size indicia provided thereon and located around the orifice of the head, and the actuating member includes an arrow for aligning and indicating either of the size indicia.

The compartment of the housing includes an inner diameter greater than that of the bore of the housing for forming an inner peripheral shoulder between the compartment and the bore of the housing and for engaging with the rotary member and for retaining the rotary member in the compartment of the housing.

The housing includes an upper peripheral groove and a lower peripheral groove formed therein and communicating with the bore of the housing, and the actuating member includes a positioning ring engageable with either the upper peripheral groove or the lower peripheral groove of the housing for anchoring and positioning the actuating member to the housing at an upper position and a lower position respectively.

The driving handle includes a retaining ring attached to the stud of the housing and contacted and engaged with the head for rotatably anchoring and retaining and positioning the housing to the head and for preventing the housing from being disengaged from the head.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
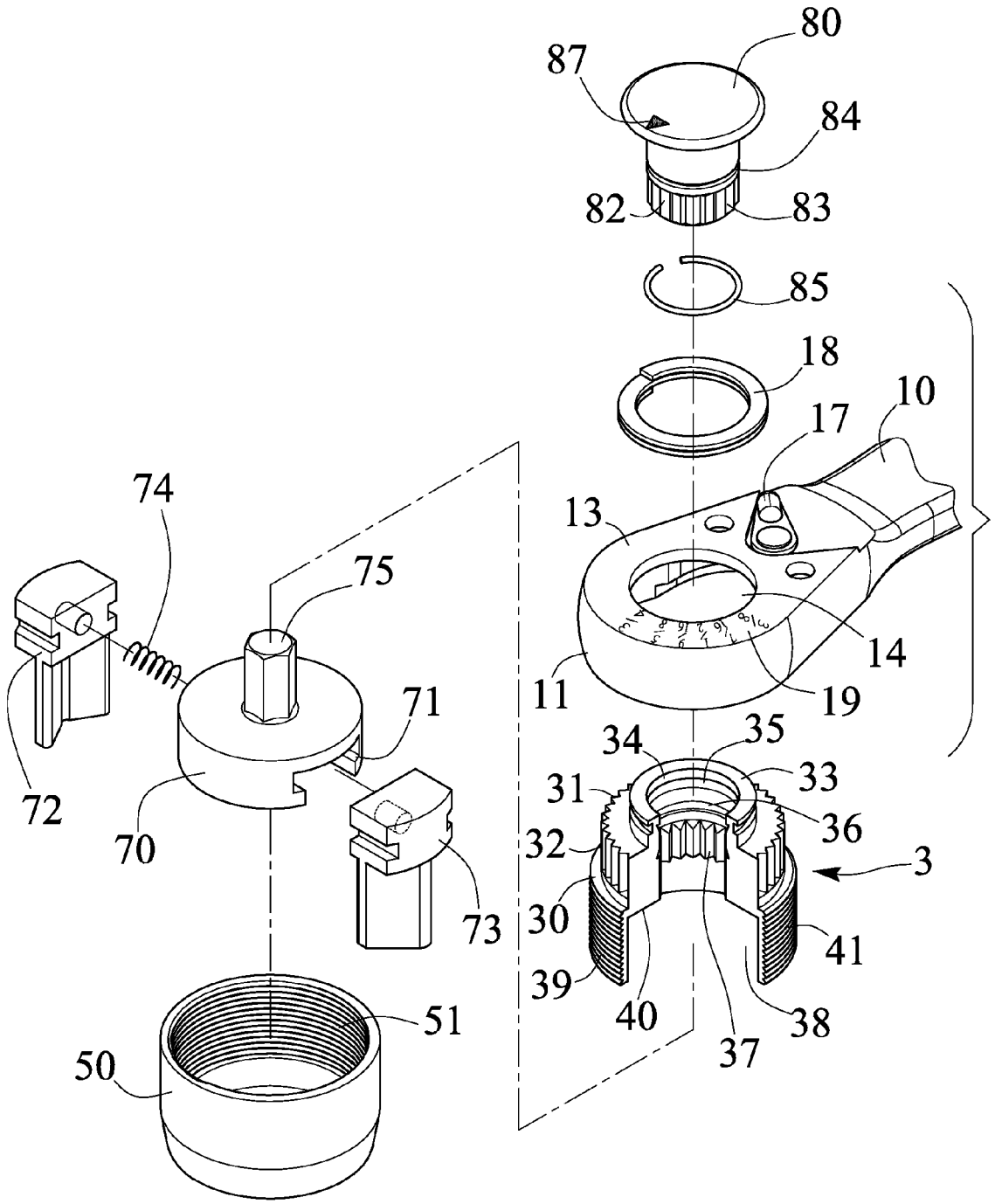
FIG. 1 is an exploded view of an adjustable wrench device in accordance with the present invention.
Figure 2:
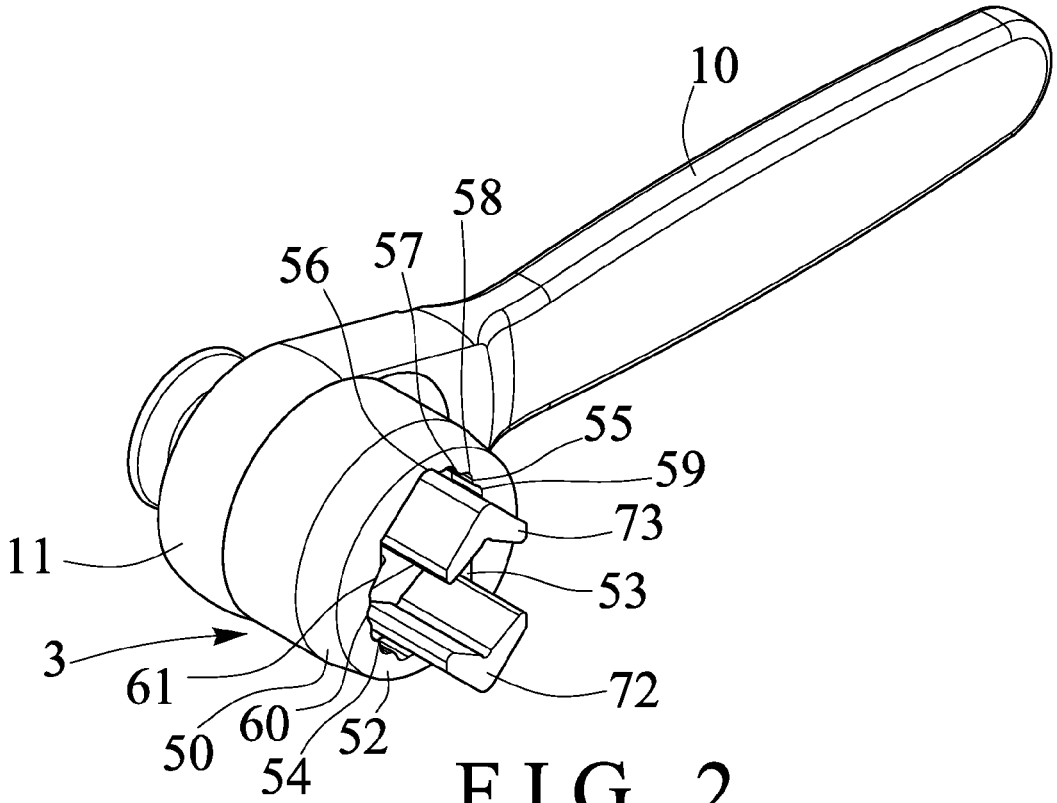
FIG. 2 is a perspective view of the adjustable wrench device.

Referring to the drawings, and initially to FIGS. 1-6, an adjustable wrench device in accordance with the present invention comprises a driving handle 10 including an enlarged head 11 formed or provided on one end portion thereof, and including a chamber 12 formed in the head 11 and formed or defined by an upper wall 13 for pivotally or rotatably receiving or engaging with a driving cartridge 3, and including an orifice 14 formed therein, such as formed in the upper wall 13 thereof and communicating with the chamber 12 of the head 11, and including a space 15 formed therein, such as formed in the head 11 and/or the handle 10 (FIGS. 5, 7) and also communicating with the chamber 12 of the head 11 for pivotally receiving or engaging with a detent 16, and including a hand grip or control knob 17 attached or mounted or secured to the detent 16 for rotating or driving the detent 16 relative to the head 11 and/or the handle 10.

For example, the driving cartridge 3 includes a cylindrical member or barrel or receptacle or housing 30 pivotally or rotatably received or engaged in the chamber 12 of the head 11, and includes a gear or gear wheel 31 formed or provided in the middle or intermediate portion 32 of the housing 30 and received or engaged in the chamber 12 of the head 11, and faced or directed toward and aligned with the detent 16 which is meshed or engageable with the gear wheel 31 for determining or controlling the driving direction of the housing 30 by the head 11 and the handle 10. The control knob 17 may rotate the detent 16 relative to the gear wheel 31 for adjusting the driving direction of the housing 30 by the head 11 and the handle 10. The above-described engaging structure or configuration for the gear wheel 31 of the housing 30 and the detent 16 and the control knob 17 is typical and is not related to the present invention and will not be described in further details.

The housing 30 includes a stud 33 extended upwardly therefrom, such as extended upwardly from the gear wheel 31 that is formed or provided in the middle or intermediate portion 32 of the housing 30, and the stud 33 includes an outer diameter smaller than that of the gear wheel 31 of the housing 30 for pivotally or rotatably engaging into or through the orifice 14 of the head 11, and a clamping or retaining ring 18 is attached or mounted or secured to the stud 33 and contacted or engaged with the head 11 for pivotally or rotatably attaching or mounting or securing or anchoring or retaining or positioning the housing 30 to the head 11 and for preventing the housing 30 from being disengaged or separated from the head 11 and the handle 10.

The housing 30 further includes a hole or space or bore 34 formed therein, such as formed in the center portion thereof and formed through the stud 33 and the gear wheel 31, and includes one or more (such as two) retaining or positioning or anchoring members, such as peripheral grooves 35, 36 formed in the inner peripheral portion thereof and communicating with the bore 34 of the housing 30, in which the upper or first peripheral groove 35 is disposed or positioned or located and arranged above the lower or second peripheral groove 36, and the housing 30 further includes another gear wheel or internal gear 37 formed or provided therein and extended into the bore 34 of the housing 30 and disposed or positioned or located below the peripheral grooves 35, 36 of the housing 30.

The housing 30 further includes an enlarged compartment 38 formed therein, such as formed in the lower portion 39 thereof and communicating with the bore 34 of the housing 30 and having an inner diameter greater than that of the bore 34 of the housing 30 for forming or defining an inner peripheral shoulder 40 between the compartment 38 and the bore 34 of the housing 30, and the housing 30 further includes an outer thread 41 formed or provided on the outer peripheral portion of the lower portion 39 of the housing 30 for threading or engaging with an outer cover or barrel or sleeve 50, in which the sleeve 50 includes an inner thread 51 formed or provided in the inner peripheral portion thereof for threading or engaging with the outer thread 41 of the housing 30 and for solidly and stably attaching or mounting or securing the sleeve 50 onto the housing 30.

The sleeve 50 includes a bottom wall or plate or panel 52 having an opening 53 formed therein, and includes two spirally arranged cam surfaces 54, 55 formed therein (FIGS. 2, 4, 8-9) and for forming or defining the opening 53 of the bottom panel 52, and the sleeve 50 further includes one or more recesses or depressions 56, 57, 58, 59, 60, 61 formed in each of the spirally arranged cam surfaces 54, 55, and the depressions 56-61 of the spirally arranged cam surfaces 54, 55 of the sleeve 50 are disposed or positioned or located and arranged anti-symmetric to each other, for example, the first pair of depressions 56 of the spirally arranged cam surfaces 54, 55 are spaced or separated from each other for a farthest distance than the spacing distance between the other or second pair of depressions 57 of the spirally arranged cam surfaces 54, 55 which is greater than the spacing distance between the further or third pair of depressions 58 of the spirally arranged cam surfaces 54, 55.

Similarly, the spacing distance between the still further or fourth pair of depressions 59 of the spirally arranged cam surfaces 54, 55 is smaller than the spacing distance between the third pair of depressions 58 of the spirally arranged cam surfaces 54, 55, and is greater than the spacing distance between the still further or fifth pair of depressions 60 of the spirally arranged cam surfaces 54, 55 which is greater than the spacing distance between the still further or sixth pair of depressions 61 of the spirally arranged cam surfaces 54, 55, and vice versa. The driving cartridge 3 further includes a block or follower or rotary member 70 pivotally or rotatably received or engaged in the compartment 38 of the housing 30 and preferably snugly fitted and engaged in the compartment 38 of the housing 30 and engaged with the inner peripheral shoulder 40 that is formed between the compartment 38 and the bore 34 of the housing 30.

For example, the rotary member 70 includes a guide track or passage or channel 71 laterally or longitudinally formed therein for slidably receiving or engaging with two jaw members 72, 73 and for guiding and limiting the jaw members 72, 73 to slide or move relative to each other or to slide or move toward or away from each other. A spring biasing member 74 is disposed or engaged between the jaw members 72, 73 for biasing and forcing or moving the jaw members 72, 73 to selectively engage with either pair of depressions 56-61 of the spirally arranged cam surfaces 54, 55, best shown in FIGS. 2, 4, 8-9. The jaw members 72, 73 are extended into or received or engaged in the opening 53 of the bottom panel 52, and the bottom panel 52 of the sleeve 50 may be contacted or engaged with the rotary member 70 for solidly and stably anchoring or retaining or positioning or confining the rotary member 70 in the compartment 38 of the housing 30.

Figure 4:
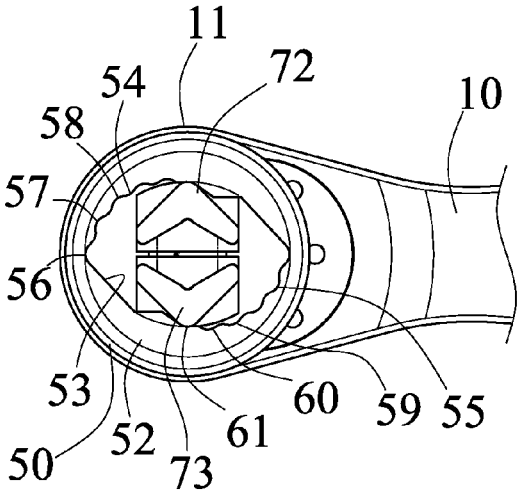
FIG. 4 is a partial bottom plan schematic view of the adjustable wrench device.
Figure 9:
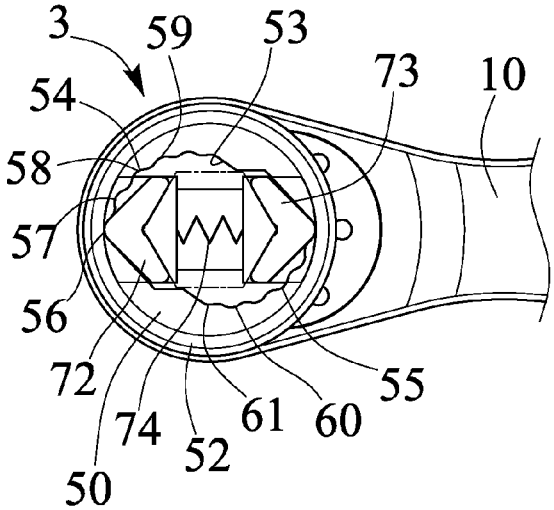

In operation, as shown in FIGS. 2, 4, 8-9, the spacing distance between the jaw members 72, 73 will be different from each other, for engaging with and for gripping various sizes or dimensions or diameters of bolt heads, nuts, and other fittings, when the jaw members 72, 73 are engage with different pair of depressions 56-61 of the spirally arranged cam surfaces 54, 55, for example, as shown in FIG. 9, when the jaw members 72, 73 are engaged with the first pair of depressions 56 of the spirally arranged cam surfaces 54, 55 that are spaced or separated from each other for the farthest distance, the jaw members 72, 73 may be used for engaging with and for gripping the greatest fitting, and may be used for engaging with and for gripping the smallest fitting when the jaw members 72, 73 are engage with the sixth pair of depressions 61 of the spirally arranged cam surfaces 54, 55 that are spaced or separated from each other for the shortest distance (FIG. 4).

The rotary member 70 further includes a stud or shank or stem 75 extended upwardly therefrom, and extended into or received or engaged in the bore 34 of the housing 30, and having a non-circular cross section, and a hand grip or control knob or operating or actuating member 80 slidably engaged into or with the bore 34 of the housing 30, and the actuating member 80 includes a non-circular hole or space or bore or orifice or cavity 81 formed therein for slidably receiving or engaging with the stem 75 and for allowing the actuating member 80 to be moved up (FIG. 7) and down (FIGS. 5, 6) relative to the head 11 and the housing 30 and the rotary member 70, and for allowing the actuating member 80 to be pivoted or rotated in concert with the rotary member 70 relative to the housing 30. The actuating member 80 includes another gear wheel or gear 82 formed or provided on the lower portion 83 thereof for selectively engaging with the internal gear 37 of the housing 30.

Figure 7:
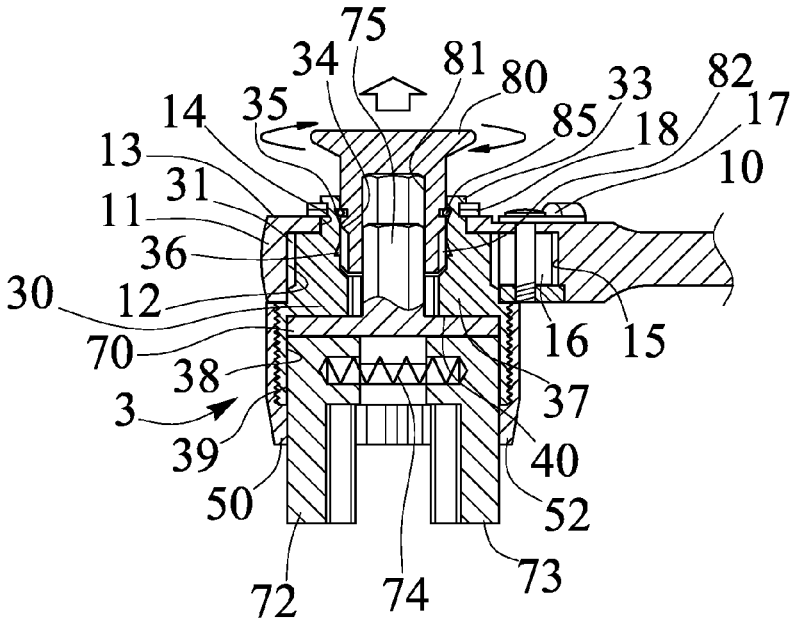
FIG. 7 is a partial cross sectional view similar to FIG. 5, illustrating the operation of the adjustable wrench device.
Figure 8:
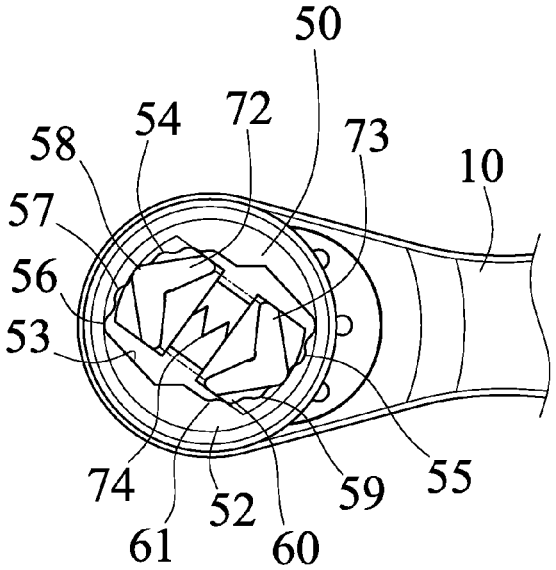
FIGS. 8, 9 are partial bottom plan schematic views similar to FIG. 4, illustrating the operation of the adjustable wrench device.

For example, as shown in FIG. 7, when the actuating member 80 is moved up or away from the rotary member 70, the gear 82 of the actuating member 80 may be spaced or disengaged or separated or released from the internal gear 37 of the housing 30, at this moment, the actuating member 80 and the rotary member 70 may be pivoted or rotated freely relative to the housing 30 and the sleeve 50, and the jaw members 72, 73 may be pivoted or rotated or moved to engage with either pair of depressions 56-61 of the spirally arranged cam surfaces 54, 55, best shown in FIGS. 2, 4, 8-9, until the spacing distance between the jaw members 72, 73 may be used for engaging with and for gripping the bolt head, nut, and other fitting of the required or selected or predetermined size or dimension or diameter or standard.

Figure 5:
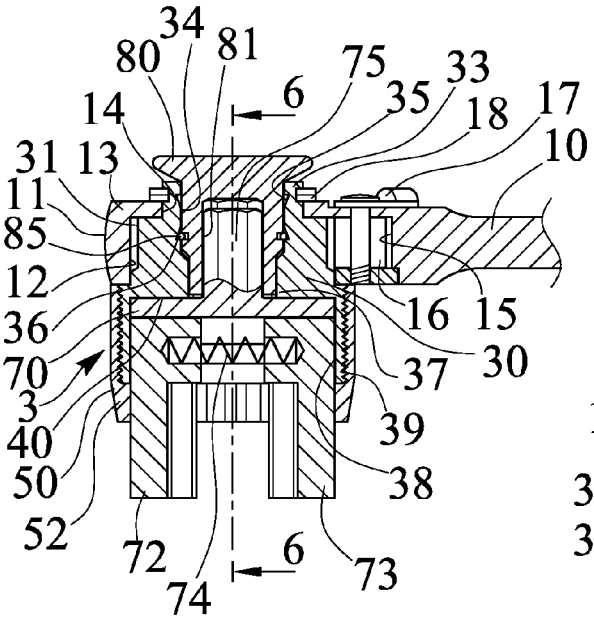
FIG. 5 is a partial cross sectional view of the adjustable wrench device, taken along lines 5-5 of FIG. 3.
Figure 6:
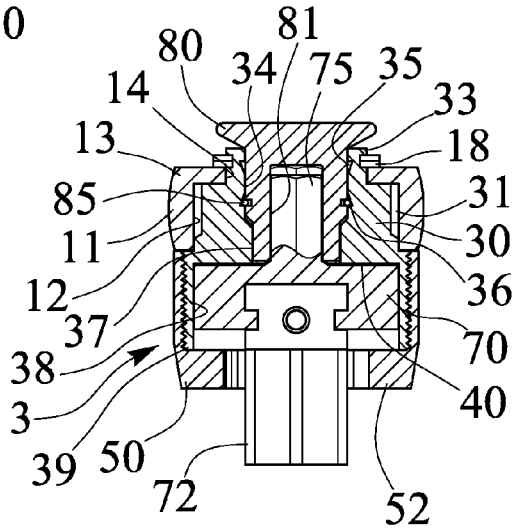
FIG. 6 is a cross sectional view of the adjustable wrench device, taken along lines 6-6 of FIG. 5.

On the contrary, as shown in FIGS. 5 and 6, after the spacing distance between the jaw members 72, 73 has been selected or determined, the actuating member 80 may be depressed and forced to move into the head 11 and the bore 34 of the housing 30 again and may force the gear 82 of the actuating member 80 to engage with the internal gear 37 of the housing 30, at this moment, the actuating member 80 and the rotary member 70 will be meshed or connected or coupled to the housing 30 and pivoted or rotated in concert with the housing 30, for allowing the rotary member 70 and the housing 30 and thus the fitting (not illustrated) disposed or engaged between the jaw members 72, 73 to be pivoted or rotated or driven by the head 11 and the driving handle 10. The actuating member 80 further includes a peripheral slot 84 formed or provided on the outer peripheral portion thereof for engaging with another clamping or retaining or positioning ring 85.

For example, the positioning ring 85 is engageable with either of the peripheral grooves 35, 36 of the housing 30 for attaching or mounting or securing or anchoring or retaining or positioning the actuating member 80 to the housing 30 at the required or selected or predetermined position or location. For example, when the gear 82 of the actuating member 80 is spaced or disengaged or separated or released from the internal gear 37 of the housing 30 (FIG. 7), the positioning ring 85 of the actuating member 80 is engaged with the upper or first peripheral groove 35 of the housing 30 for positioning the actuating member 80 to the housing 30 at the upper or first working position. On the contrary, the positioning ring 85 of the actuating member 80 may be engaged with the lower or second peripheral groove 36 of the housing 30 for anchoring or retaining or positioning the actuating member 80 to the housing 30 at the lower or second working position when the gear 82 of the actuating member 80 is meshed or engaged with the internal gear 37 of the housing 30 (FIGS. 5 and 6).

Figure 3:
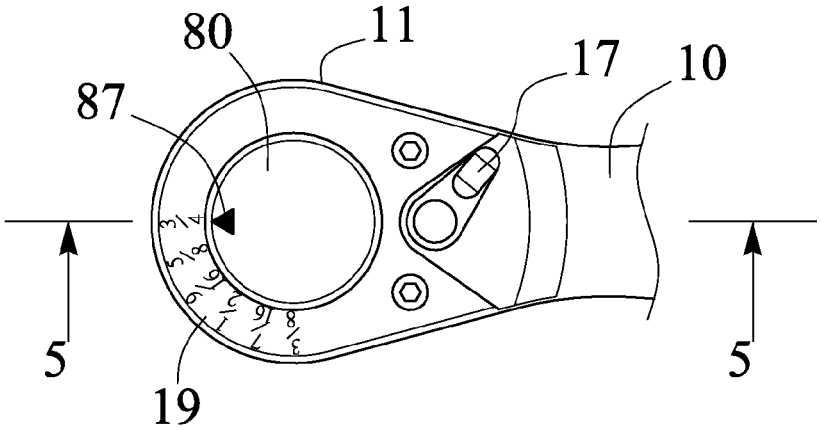
FIG. 3 is a partial top plan schematic view of the adjustable wrench device.

It is to be noted that the rotary member 70 and thus the jaw members 72, 73 may be easily and quickly pivoted or rotated relative to the housing 30 and the sleeve 50 in order to adjust the spacing distance between the jaw members 72, 73 when the actuating member 80 is moved up or away from the rotary member 70 and when the gear 82 of the actuating member 80 is spaced or disengaged or separated or released from the internal gear 37 of the housing 30, and the wrench device includes an improved structure or configuration may be easily and quickly made or manufactured by the workers with a reduced manufacturing cost. As shown in FIGS. 1 and 3, the handle 10 may include a size indicia 19, such as the ⅜, 7/16, ½, 9/16, ⅝, ¾ size markings 19 formed or provided thereon, such as formed or provided on the head 11 and disposed or positioned or located around the orifice 14 of the head 11, and the actuating member 80 may include an index or arrow 87 for aligning or indicating either of the size indicia 19 or size markings 19.

Accordingly, the adjustable wrench device in accordance with the present invention includes two opposed slidable jaw members that enables a user to quickly adjust to various sizes or dimensions by rotating a portion of the wrench device, and includes fewer parts or components that may be easily and quickly made or manufactured by the workers and that includes a reduced manufacturing cost for the wrench device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable wrench device comprising:

a driving handle including a head provided on one end portion of said handle, and including a chamber formed in said head and defined by an upper wall, and including an orifice formed in said upper wall of said head and communicating with said chamber of said head, and including a space formed in said handle and communicating with said chamber of said head, a driving cartridge including a housing rotatably received and engaged in said chamber of said head, and including a gear wheel formed on said housing and engaged in said chamber of said head, said housing including a stud extended upwardly therefrom and engaged through said orifice of said head for rotatably mounting said housing to said head, a detent pivotally received and engaged in said space of said handle and engaged with said gear wheel for determining a driving direction of said housing by said head and said handle, a control knob attached to said detent for rotating said detent relative to said head and said handle and said housing, said housing including a bore formed therein, and including an internal gear provided in said bore of said housing, and including a compartment formed in said housing and communicating with said bore of said housing, said driving cartridge including a rotary member rotatably received and engaged in said compartment of said housing, and including a sleeve attached to said housing and having a bottom panel engaged with said rotary member for confining said rotary member in said compartment of said housing, said sleeve including an opening formed in said bottom panel and including two spirally arranged cam surfaces for forming and defining said opening of said bottom panel, and including a first pair of depressions and at least one second pair of depressions formed in said spirally arranged cam surfaces and positioned and arranged anti-symmetric to each other, said rotary member including a guide channel formed therein, and two jaw members slidably received and engaged with said guide channel of said rotary member and guided to move toward and away from each other, in order to selectively engage with either said first pair or said at least one second pair of depressions of said spirally arranged cam surfaces and in order to adjust a spacing distance between said jaw members, and said rotary member including a non-circular stem extended upwardly therefrom and received in said bore of said housing, and said driving cartridge including an actuating member slidably engaged into said bore of said housing, and said actuating member including a non-circular cavity formed therein for slidably receiving and engaging with said stem and for guiding said actuating member to be moved up and down relative to said head and said rotary member, and for allowing said actuating member to be rotated in concert with said rotary member relative to said housing, said actuating member including a gear for selectively engaging with said internal gear of said housing and for anchoring and retaining an engagement of said jaw members with either said first pair or said at least one second pair of depressions of said spirally arranged cam surfaces, and said gear of said actuating member being disengaged from said internal gear of said housing when said actuating member is moved up relative to said head and said rotary member, for allowing said actuating member and said rotary member and said jaw members to be rotated and adjusted relative to said housing and said sleeve.

2. The adjustable wrench device as claimed in claim 1, wherein said rotary member includes a spring biasing member disposed and engaged between said jaw members for biasing and forcing and moving said jaw members to selectively engage with either said first pair or said at least one second pair of depressions of said spirally arranged cam surfaces.

3. The adjustable wrench device as claimed in claim 1, wherein said housing includes an outer thread formed thereon, and said sleeve includes an inner thread for threading and engaging with said outer thread of said housing and for mounting and securing said sleeve to said housing.

4. The adjustable wrench device as claimed in claim 1, wherein said compartment of said housing includes an inner diameter greater than that of said bore of said housing for forming an inner peripheral shoulder between said compartment and said bore of said housing and for engaging with said rotary member and for retaining said rotary member in said compartment of said housing.

5. The adjustable wrench device as claimed in claim 1, wherein said housing includes an upper peripheral groove and a lower peripheral groove formed therein and communicating with said bore of said housing, and said actuating member includes a positioning ring engageable with either said upper peripheral groove or said lower peripheral groove of said housing for anchoring and positioning said actuating member to said housing at an upper position and a lower position respectively.

6. The adjustable wrench device as claimed in claim 1, wherein said driving handle includes a retaining ring attached to said stud of said housing and contacted and engaged with said head for rotatably anchoring and retaining and positioning said housing to said head and for preventing said housing from being disengaged from said head.

7. The adjustable wrench device as claimed in claim 1, wherein said head includes a size indicia provided thereon and located around said orifice of said head, and said actuating member includes an arrow for aligning and indicating either of said size indicia.

* * * * *